US010118731B2

(12) United States Patent
Apps et al.

(10) Patent No.: US 10,118,731 B2
(45) Date of Patent: Nov. 6, 2018

(54) PALLET ASSEMBLY

(71) Applicant: Rehrig Pacific Company, Los Angeles, CA (US)

(72) Inventors: William P. Apps, Alpharetta, GA (US); Christopher N. Gab, Olathe, KS (US)

(73) Assignee: REHRIG PACIFIC COMPANY, Los Angeles, CA (US)

( * ) Notice: Subject to any disclaimer, the term of this patent is extended or adjusted under 35 U.S.C. 154(b) by 0 days.

(21) Appl. No.: 15/176,981

(22) Filed: Jun. 8, 2016

(65) Prior Publication Data

US 2017/0021963 A1 Jan. 26, 2017

Related U.S. Application Data

(60) Provisional application No. 62/172,474, filed on Jun. 8, 2015.

(51) Int. Cl.
*B65D 19/00* (2006.01)

(52) U.S. Cl.
CPC ..... *B65D 19/0069* (2013.01); *B65D 2519/00034* (2013.01); *B65D 2519/00069* (2013.01); *B65D 2519/0086* (2013.01); *B65D 2519/00129* (2013.01); *B65D 2519/00139* (2013.01); *B65D 2519/00273* (2013.01); *B65D 2519/00293* (2013.01); *B65D 2519/00318* (2013.01); *B65D 2519/00323* (2013.01); *B65D 2519/00333* (2013.01); *B65D 2519/00407* (2013.01); *B65D 2519/00412* (2013.01); *B65D 2519/00437* (2013.01); *B65D 2519/00442* (2013.01); *B65D 2519/00562* (2013.01)

(58) Field of Classification Search
CPC ..... B65D 2519/00034; B65D 2519/00273; B65D 2519/00069; B65D 2519/00104; B65D 2519/00268; B65D 19/06
USPC .... 108/57.25, 51.11, 901, 902, 57.26, 57.27, 108/57.28
See application file for complete search history.

(56) References Cited

U.S. PATENT DOCUMENTS

| | | | |
|---|---|---|---|
| 3,572,535 | A | 3/1971 | Kinzie |
| 3,610,173 | A | 10/1971 | Mcilwraith |
| 3,699,902 | A | 10/1972 | Allgeyer |
| 4,727,102 | A | 2/1988 | Scarso |
| 4,735,154 | A | 4/1988 | Hemery |

(Continued)

FOREIGN PATENT DOCUMENTS

| | | | |
|---|---|---|---|
| CA | 2409089 | A1 | 4/2003 |
| CA | 2409570 | A1 | 4/2003 |

(Continued)

*Primary Examiner* — Jose V Chen
(74) *Attorney, Agent, or Firm* — Carlson, Gaskey & Olds, P.C.

(57) ABSTRACT

A pallet includes fire retardant coatings to improve the overall fire performance of the pallet. First, the coatings may be used in combination with fire retardant additives in the plastic material of the pallet in order to reduce the amount of additives, thereby reducing cost and improving the structural performance of the pallet. Alternatively or additionally, the fire retardant coatings may be placed inside the pallet. This eliminates the chance that the fire retardant coating will get worn off during use. For example, the coating could be placed between the reinforcement sheet and the deck or runners, within the columns, etc.

21 Claims, 9 Drawing Sheets

(56) References Cited

U.S. PATENT DOCUMENTS

| | | | | |
|---|---|---|---|---|
| 5,137,777 | A | 8/1992 | Silverman et al. | |
| 5,143,778 | A | 9/1992 | Shuert | |
| 5,413,052 | A | 5/1995 | Breezer et al. | |
| 5,676,064 | A | 10/1997 | Shuert | |
| 5,687,532 | A | 11/1997 | Torrey | |
| 5,687,652 | A | 11/1997 | Ruma | |
| 5,879,495 | A | 3/1999 | Evans | |
| 5,989,706 | A * | 11/1999 | McGinniss | C09D 5/185 106/18.11 |
| 6,006,677 | A | 12/1999 | Apps et al. | |
| 6,199,488 | B1 | 3/2001 | Favaron et al. | |
| 6,228,914 | B1 | 5/2001 | Ford et al. | |
| 6,250,234 | B1 | 6/2001 | Apps | |
| 6,283,044 | B1 | 9/2001 | Apps | |
| 6,289,823 | B1 | 9/2001 | Koefelda et al. | |
| 6,294,114 | B1 | 9/2001 | Muirhead | |
| 6,305,301 | B1 | 10/2001 | Piper, Jr. et al. | |
| 6,344,508 | B1 | 2/2002 | Endo et al. | |
| 6,389,990 | B1 | 5/2002 | Apps | |
| 6,530,476 | B1 | 3/2003 | Overholt | |
| 6,622,641 | B2 | 9/2003 | Smyers | |
| 6,644,219 | B2 | 11/2003 | Apps | |
| 6,659,019 | B2 | 12/2003 | Gruber et al. | |
| 6,705,237 | B2 | 3/2004 | Moore, Jr. et al. | |
| 6,718,888 | B2 | 4/2004 | Muirhead | |
| 6,745,703 | B2 | 6/2004 | Torrey et al. | |
| 6,758,148 | B2 | 7/2004 | Torrey et al. | |
| 6,784,234 | B2 | 8/2004 | Adedeji et al. | |
| 6,805,061 | B2 | 10/2004 | Smyers et al. | |
| 6,807,910 | B2 | 10/2004 | Apps | |
| 6,840,181 | B2 | 1/2005 | Smyers | |
| 6,849,677 | B2 | 2/2005 | Overholt | |
| 6,874,428 | B2 | 4/2005 | Apps | |
| 6,886,475 | B2 | 5/2005 | Apps et al. | |
| 6,938,321 | B2 | 9/2005 | Hentges et al. | |
| 6,955,128 | B2 | 10/2005 | Apps | |
| 6,998,433 | B2 | 2/2006 | Overholt et al. | |
| 7,086,339 | B2 | 8/2006 | Apps et al. | |
| 7,086,340 | B2 | 8/2006 | Apps | |
| 7,165,499 | B2 | 1/2007 | Apps et al. | |
| 7,197,989 | B2 | 4/2007 | Apps | |
| 7,216,415 | B2 | 5/2007 | Hentges et al. | |
| 7,216,592 | B2 | 5/2007 | Krech et al. | |
| 7,252,041 | B2 | 8/2007 | Overholt et al. | |
| 7,293,509 | B2 | 11/2007 | Hassell | |
| 7,378,463 | B2 | 5/2008 | Abu-Isa | |
| 7,484,634 | B2 | 2/2009 | Apps | |
| 7,640,867 | B2 | 1/2010 | Ogburn et al. | |
| 7,644,666 | B2 | 1/2010 | Smyers | |
| 7,661,373 | B2 | 2/2010 | Apps et al. | |
| 7,690,315 | B2 | 4/2010 | Apps | |
| 7,735,430 | B2 | 6/2010 | Muirhead | |
| 7,748,329 | B2 | 7/2010 | Baltz | |
| 7,779,763 | B2 | 8/2010 | Valentinsson | |
| 7,819,068 | B2 | 10/2010 | Apps et al. | |
| 7,845,289 | B2 | 12/2010 | Apps | |
| 7,874,256 | B2 | 1/2011 | Muirhead | |
| 7,918,166 | B2 | 4/2011 | Apps et al. | |
| 7,921,784 | B2 | 4/2011 | Ogburn et al. | |
| 8,052,000 | B2 | 11/2011 | Apps | |
| 8,056,488 | B2 | 11/2011 | Apps et al. | |
| 8,091,487 | B2 | 1/2012 | Apps | |
| 8,132,758 | B2 | 3/2012 | Army et al. | |
| 8,191,486 | B2 | 6/2012 | Apps et al. | |
| 8,210,108 | B2 | 7/2012 | Apps | |
| 8,215,244 | B2 | 7/2012 | Apps | |
| 8,230,793 | B2 | 7/2012 | Apps | |
| 8,291,838 | B2 | 10/2012 | Apps | |
| 8,291,839 | B2 | 10/2012 | Apps et al. | |
| 8,438,981 | B2 | 5/2013 | Linares | |
| 8,448,583 | B2 | 5/2013 | Apps et al. | |
| 8,448,584 | B2 | 5/2013 | Apps | |
| 8,720,692 | B2 | 5/2014 | Apps | |
| 8,770,115 | B2 | 7/2014 | Apps et al. | |
| 8,967,056 | B2 | 3/2015 | Apps et al. | |
| 9,010,255 | B2 | 4/2015 | Baltz | |
| 9,038,273 | B2 | 5/2015 | Grgac et al. | |
| 9,221,580 | B2 | 12/2015 | Zelek et al. | |
| 9,272,810 | B2 | 3/2016 | Ogburn | |
| 9,452,864 | B2 | 9/2016 | Apps | |
| 2001/0029874 | A1 | 10/2001 | Muirhead | |
| 2001/0031807 | A1 | 10/2001 | Adedeji et al. | |
| 2002/0175435 | A1 | 11/2002 | Weiland et al. | |
| 2003/0079658 | A1 | 5/2003 | Torrey et al. | |
| 2003/0079660 | A1 | 5/2003 | Torrey et al. | |
| 2004/0261669 | A1 | 12/2004 | Apps | |
| 2005/0145145 | A1 | 7/2005 | Ogburn et al. | |
| 2006/0004134 | A1 | 1/2006 | Overholt et al. | |
| 2006/0011108 | A1 | 1/2006 | Abu-Isa et al. | |
| 2006/0162624 | A1 | 7/2006 | Hassell | |
| 2006/0201402 | A1 | 9/2006 | Moore et al. | |
| 2006/0236903 | A1 | 10/2006 | Moore | |
| 2006/0249058 | A1 | 11/2006 | Moore et al. | |
| 2006/0272556 | A1 | 12/2006 | Apps | |
| 2007/0000415 | A1 | 1/2007 | Moore | |
| 2007/0056483 | A1 | 3/2007 | Garcia | |
| 2007/0062420 | A1 | 3/2007 | Apps et al. | |
| 2008/0053342 | A1 | 3/2008 | Muirhead | |
| 2008/0083355 | A1 | 4/2008 | Meissen | |
| 2008/0210140 | A1 | 9/2008 | Valentinsson | |
| 2009/0053033 | A1 | 2/2009 | Barbalho et al. | |
| 2009/0114129 | A1 | 5/2009 | Smith et al. | |
| 2009/0183655 | A1 | 7/2009 | Ogburn | |
| 2010/0212553 | A1 | 8/2010 | Baltz | |
| 2011/0120353 | A1 | 5/2011 | Jensen et al. | |
| 2011/0162563 | A1 | 7/2011 | Ogburn et al. | |
| 2011/0259249 | A1 | 10/2011 | Ogburn et al. | |
| 2011/0303128 | A1 | 12/2011 | Linares | |
| 2012/0073479 | A1 | 3/2012 | Apps | |
| 2012/0325125 | A1 | 12/2012 | Apps et al. | |
| 2013/0145971 | A1 | 6/2013 | Federl et al. | |
| 2014/0208990 | A1 | 7/2014 | Brandt et al. | |
| 2014/0251190 | A1 | 9/2014 | Kessler | |
| 2014/0283714 | A1 | 9/2014 | Wahl | |
| 2014/0319302 | A1 | 10/2014 | Baltz | |
| 2015/0203138 | A1 | 7/2015 | Hassell et al. | |
| 2015/0225215 | A1 | 8/2015 | King et al. | |
| 2015/0274357 | A1* | 10/2015 | Linares | B05D 3/12 428/131 |
| 2015/0298951 | A1 | 10/2015 | Apps et al. | |

FOREIGN PATENT DOCUMENTS

| | | | |
|---|---|---|---|
| EP | 0775637 | A1 | 5/1997 |
| EP | 0806539 | A1 | 11/1997 |
| EP | 1306311 | A2 | 5/2003 |
| EP | 1306312 | A1 | 5/2003 |
| EP | 1520792 | A2 | 4/2005 |
| EP | 1306312 | B1 | 12/2006 |
| GB | 2412107 | A | 9/2005 |
| GB | 2412107 | B | 12/2008 |
| JP | 11278485 | A | 10/1999 |
| WO | 0020495 | A1 | 4/2000 |
| WO | 0216214 | A2 | 2/2002 |

* cited by examiner

PALLET ASSEMBLY

BACKGROUND OF THE INVENTION

The present invention relates generally to pallets. Pallets generally include an upper deck having columns extending downwardly therefrom to support goods thereon above the floor and to provide openings below the deck for the tines of a forklift.

At times, it is desirable to add additives to the material of the pallet in order to improve its resistance to fire. However, these additives can cause other physical properties of the pallet to decrease, such as strength, toughness and stiffness.

SUMMARY OF THE INVENTION

One or more inventive features may be provided in a pallet to improve the performance of the pallet in the event of a fire. A reinforced, rackable, non-nestable pallet with runners is used to explain all of the features, but some features would be applicable to other types of pallets (not reinforced and/or nestable). By using one or more of the inventive features, the amount of fire retardant additives added to selected plastic parts of the pallet assembly can be reduced (or eliminated).

First, adding fire retardant coatings to the pallet assembly can be used to improve the overall fire performance of the pallet. The coatings can be used in combination with fire retardant additives in the plastic material of the pallet in order to reduce the amount of additives, thereby reducing cost and improving the structural performance of the pallet.

As another feature, the fire retardant coatings may be placed inside the pallet assembly. This eliminates the chance that the fire retardant coating will get worn off during use. For example, the coating could be placed between the reinforcement sheet and the deck or runners, within the columns, etc. The coating could be placed on the surfaces of the plastic parts (reinforcement sheets, decks, columns) and/or could be placed on or in the reinforcement rods (which may be metal or plastic). The fire retardant coatings could be Aluminum Trihydrate (ATH), Intumescents, Intumscents combined with MDH and ATH, etc.

Encapsulating the coatings between pallet assembly components can be done whether or not the plastic of the pallet assembly is made with fire retardant additives; however, with the coatings, amount of fire retardant additives in the plastic pallet components can be reduced, thereby improving their performance properties. In the event of a fire, the upper reinforcement sheet will partially burn away early in the fire and expose the fire retardant coatings within.

These and other features of the application can be best understood from the following specification and drawings, the following of which is a brief description.

DETAILED DESCRIPTION OF THE PREFERRED EMBODIMENT

Figure 1:
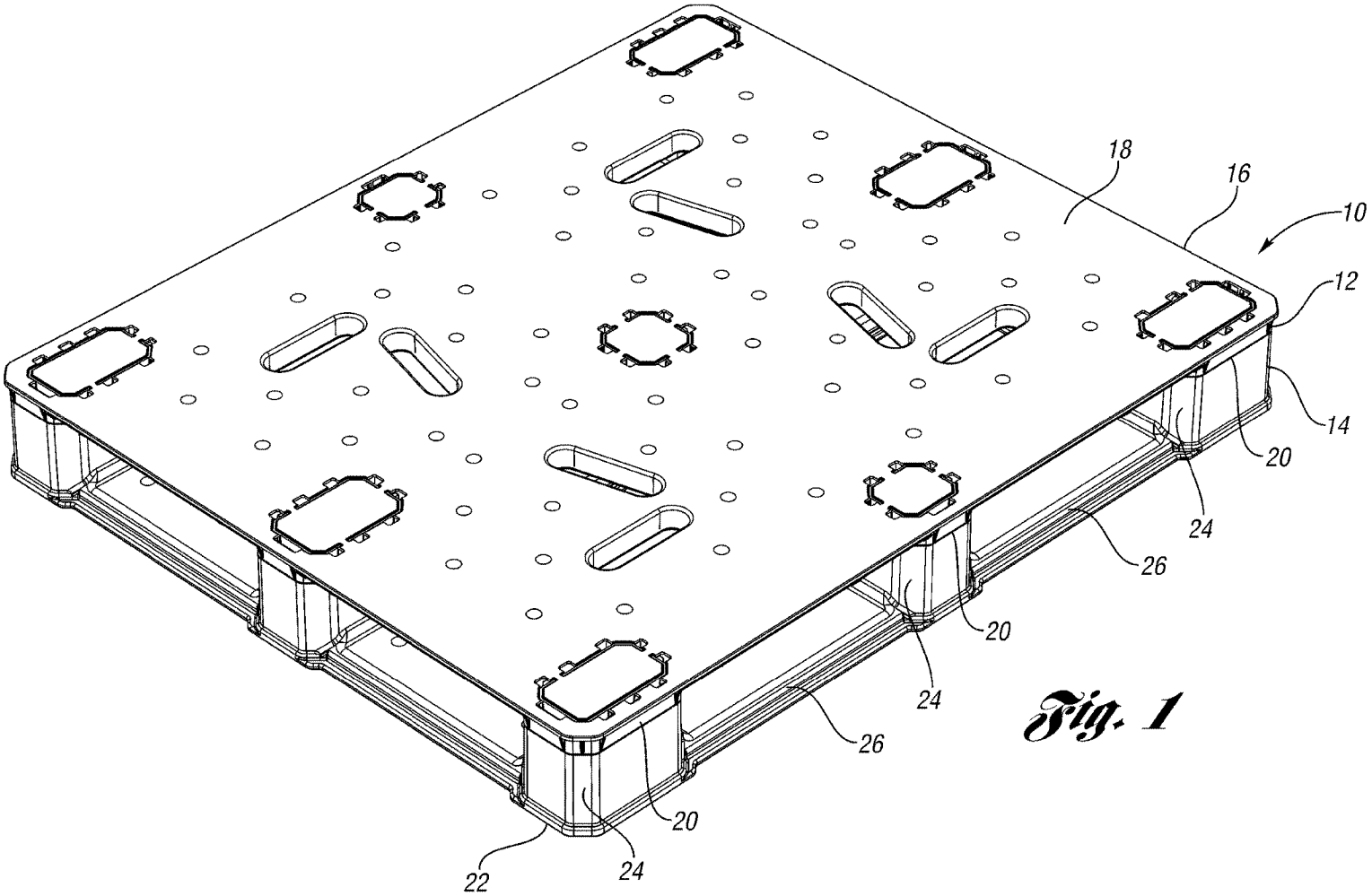
FIG. 1 is a perspective view of a pallet according to one embodiment of the present invention.

A pallet assembly 10 according to one embodiment of the present invention is shown in FIG. 1. The type of pallet assembly 10 shown is for purposes of illustration only because the reinforced rackable pallet with runners shows the most options of the present invention. However it should be understood that other types of pallets, such as nestable pallets, could also benefit from the present invention.

The pallet assembly 10 generally includes an upper structure 12 and a lower structure 14. The upper structure 12 includes an upper deck 16 having an upper support surface on a generally planar upper planar portion 18 (or sheet) and a plurality of column connectors 20 protruding downwardly therefrom. The lower structure 14 includes an integrally molded lower portion 22 including a plurality of supports or columns 24 with runners 26 extending therebetween.

Figure 2:
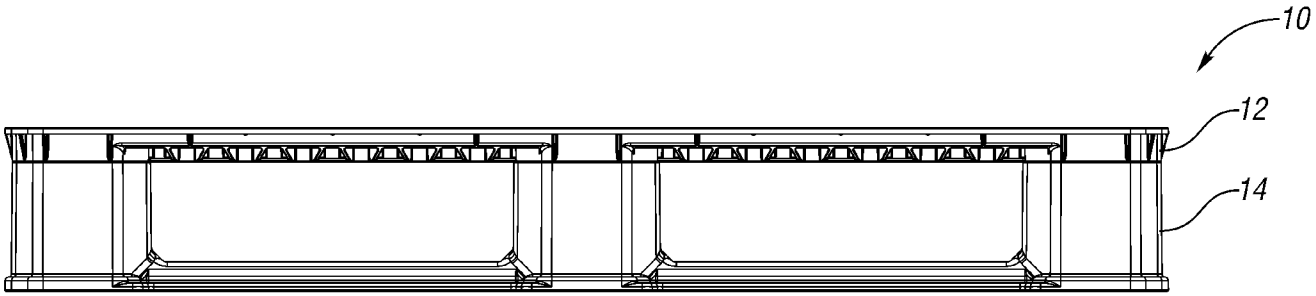
FIG. 2 is a front view of the pallet of FIG. 1.
Figure 3:
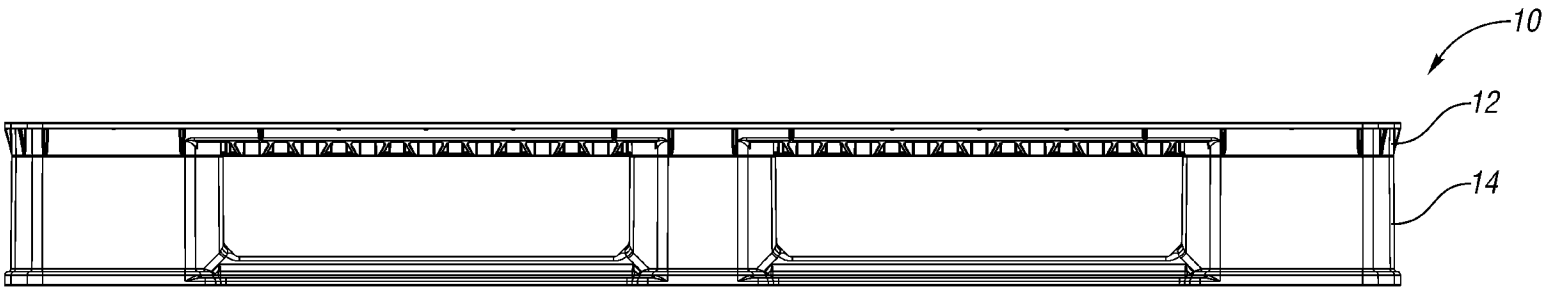
FIG. 3 is a side view of the pallet of FIG. 1.
Figure 4:
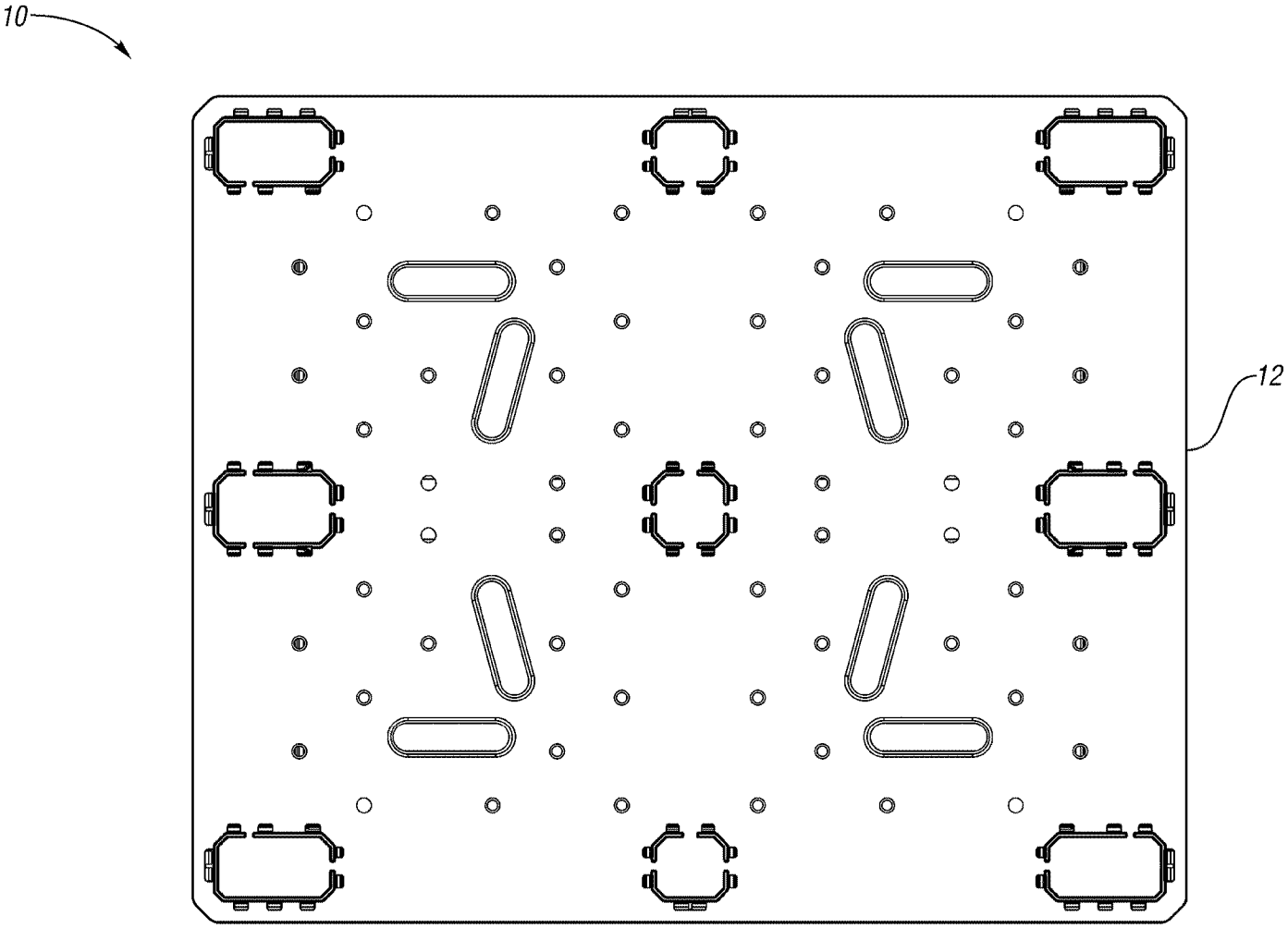
FIG. 4 is a top view of the pallet of FIG. 1.

FIGS. 2 and 3 are front and side views of the pallet assembly 10. FIG. 4 is a top view of the pallet assembly 10.

Figure 5:
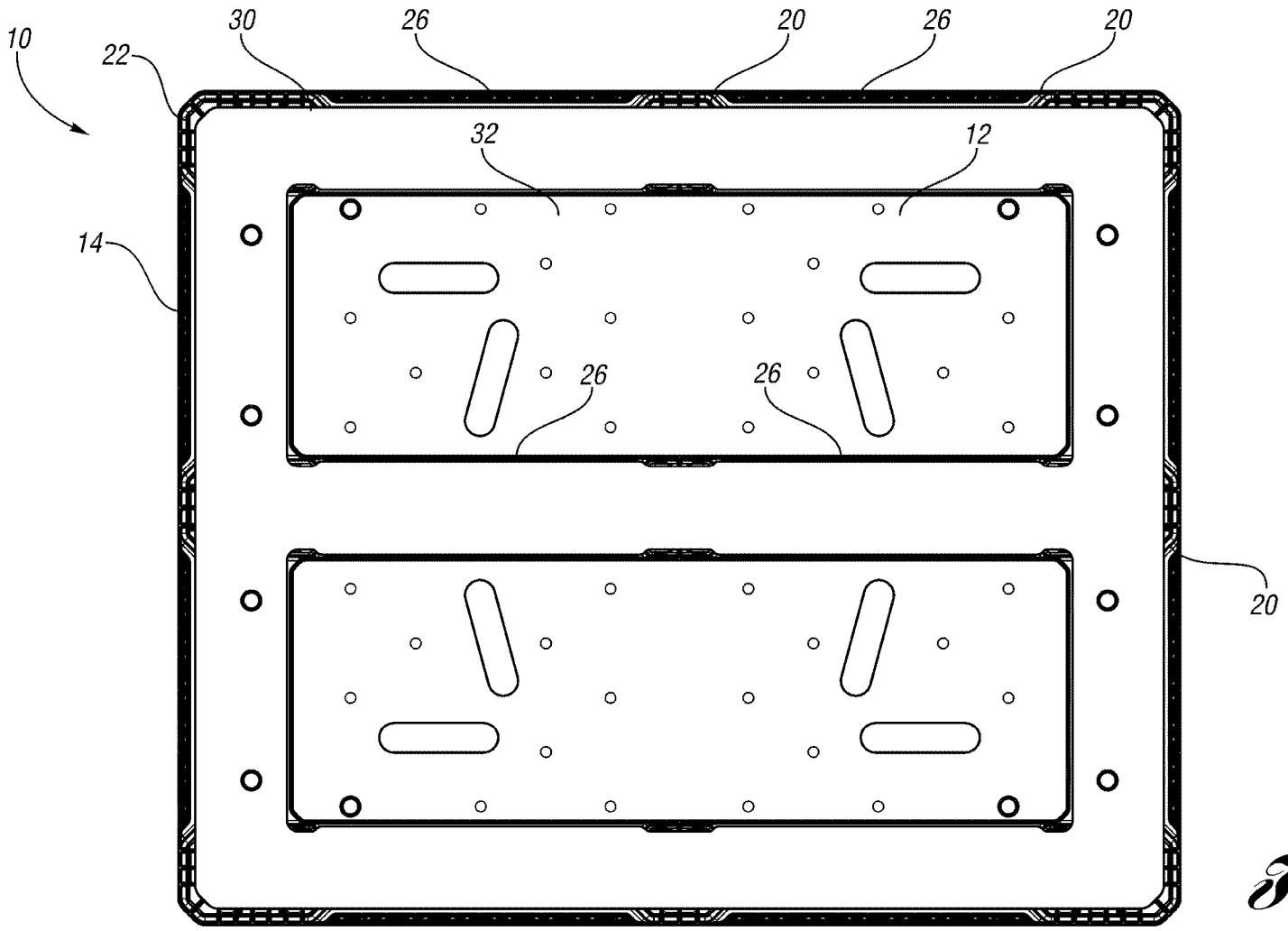
FIG. 5 is a bottom view of the pallet of FIG. 1.

FIG. 5 is a bottom view of the pallet assembly 10. As shown, the lower structure 14 includes a lower reinforcement sheet 30, shaped to align with the runners 26 and the columns 24. The upper structure 12 includes a lower planar portion or upper reinforcement sheet 32 secured to the bottom thereof.

Figure 6:
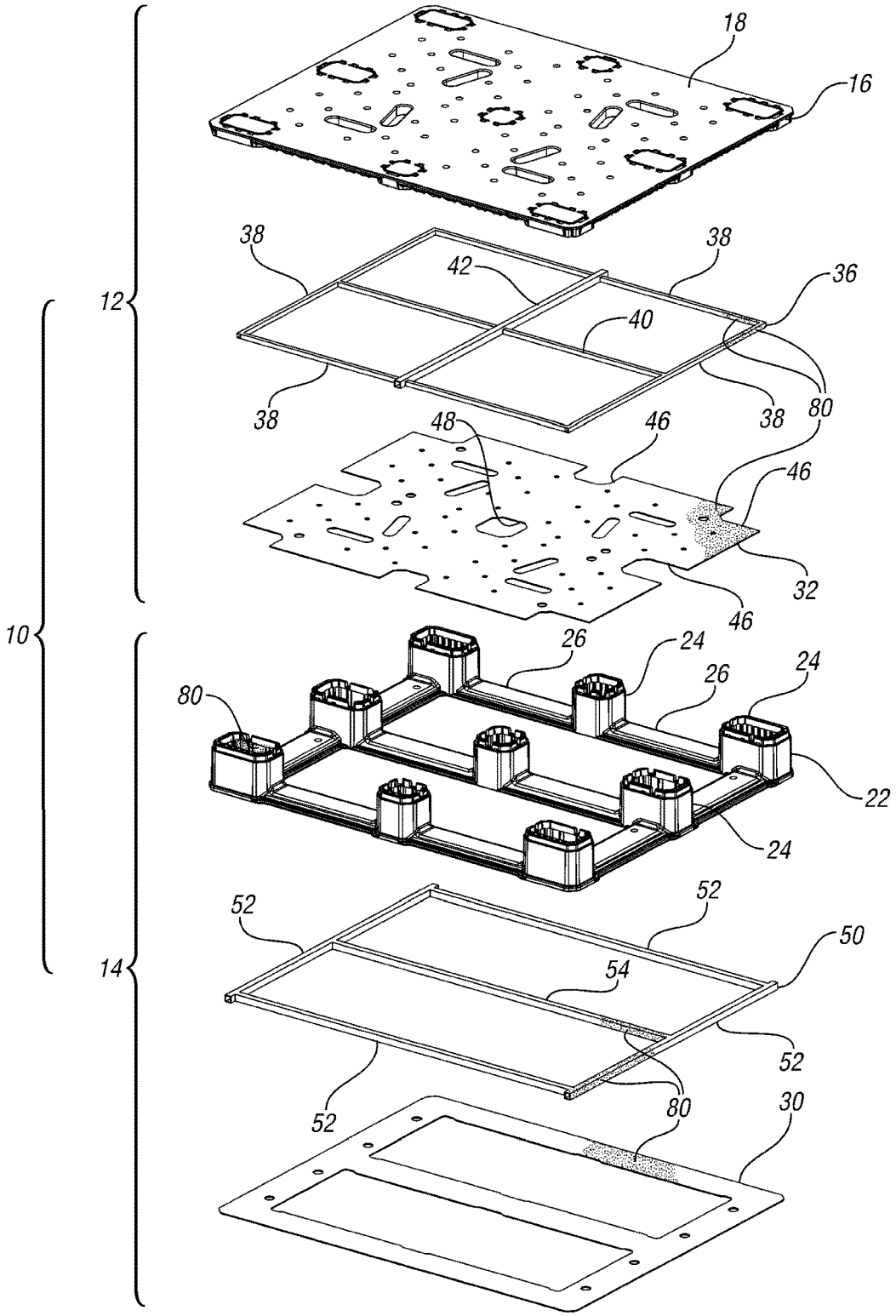
FIG. 6 is an exploded perspective view of the pallet of FIG. 1.

An exploded view of the pallet assembly 10 is shown in FIG. 6. The upper structure 12 includes the upper deck 16, reinforcement frame 36 and the upper reinforcement sheet 32. The upper deck 16 is injection molded as a single piece of plastic, such as polypropylene. The reinforcement frame 36 includes a plurality of elongated, hollow rods, preferably having a rectangular cross-section. The rods include peripheral rods 38 forming a periphery of the reinforcement frame 36 and optionally welded to one another. A longitudinal reinforcement rod 40 extends longitudinally along a center of the reinforcement frame 36 between opposite front and rear peripheral rods 38. A lateral reinforcement rod 42 extends along a center-line between opposite side peripheral rods 38. Angled reinforcement rods (not shown) may optionally extend diagonally across each of the quadrants formed by the rods 38, 40, 42. The reinforcement rods 38, 40, 42 may be metal (such as steel or aluminum) or a reinforced extruded polymer material. Alternative arrangements of the reinforcement rods could also be used, such as where the reinforcement rods 38 are continuous and the lateral reinforcement rod 42 is shorter, extending from inner surface to inner surface.

The upper reinforcement sheet 32 is generally a planar single piece of plastic (such as polypropylene) extruded as a sheet and having peripheral column openings 46 around its periphery, including the corners, and a central column opening 48. The upper reinforcement sheet 32 could also be injection molded.

The lower structure 14 includes the lower portion 22 integrally injection molded as a single piece of plastic (such as polypropylene) including the columns 24 and runners 26. A lower reinforcement frame 50 includes a plurality of peripheral reinforcement rods 52 around a periphery, which may optionally be welded to one another. A longitudinal reinforcement rod 54 may extend along a center line longitudinally between two opposite peripheral reinforcement rods 52. The reinforcement rods 52, 54 may be metal (such as steel or aluminum) or a reinforced extruded polymer material. A lower reinforcement sheet 30 is generally shaped to align with the bottom of the lower portion 22.

Referring again to FIG. 6, although the pallet assembly 10 is illustrated with all of the reinforcements (i.e. reinforcement rods and reinforcement sheets), the pallet assembly 10 can be configured with various combinations of the reinforcements depending on the application. For example, one configuration might not include any of the reinforcements at all. Another configuration would include only the peripheral reinforcement rods 52 and the longitudinal reinforcement rod 54 in the lower structure 14 and only the longitudinal reinforcement rod 40 in the upper structure 12. Another configuration would include the peripheral reinforcement rods 52 and the longitudinal reinforcement rod 54 in the lower structure 14 and peripheral rods 38, the longitudinal reinforcement rod 40 and the lateral reinforcement rod 42 in the upper structure 12. Another configuration would include the peripheral reinforcement rods 52 and the longitudinal reinforcement rod 54 in the lower structure 14 and peripheral rods 38, the longitudinal reinforcement rod 40, the lateral reinforcement rod 42 and the angled reinforcement rods (not shown) in the upper structure 12. The various reinforcement rods can be different sizes (gauge), depending on the application, as are the channels in the bottoms of the deck and runners for receiving the rods. For example, the peripheral reinforcement rods 38 (and the corresponding channels in the upper deck 16) could have a smaller cross-section (e.g. ½", which is less than half the total height of the upper deck 16) than the other rods and channels (e.g. ¾"). Therefore, when the channels are welded shut by the upper reinforcement sheet 32, the upper deck 16 will be strong with or without the peripheral reinforcement rods 38.

Figure 7:
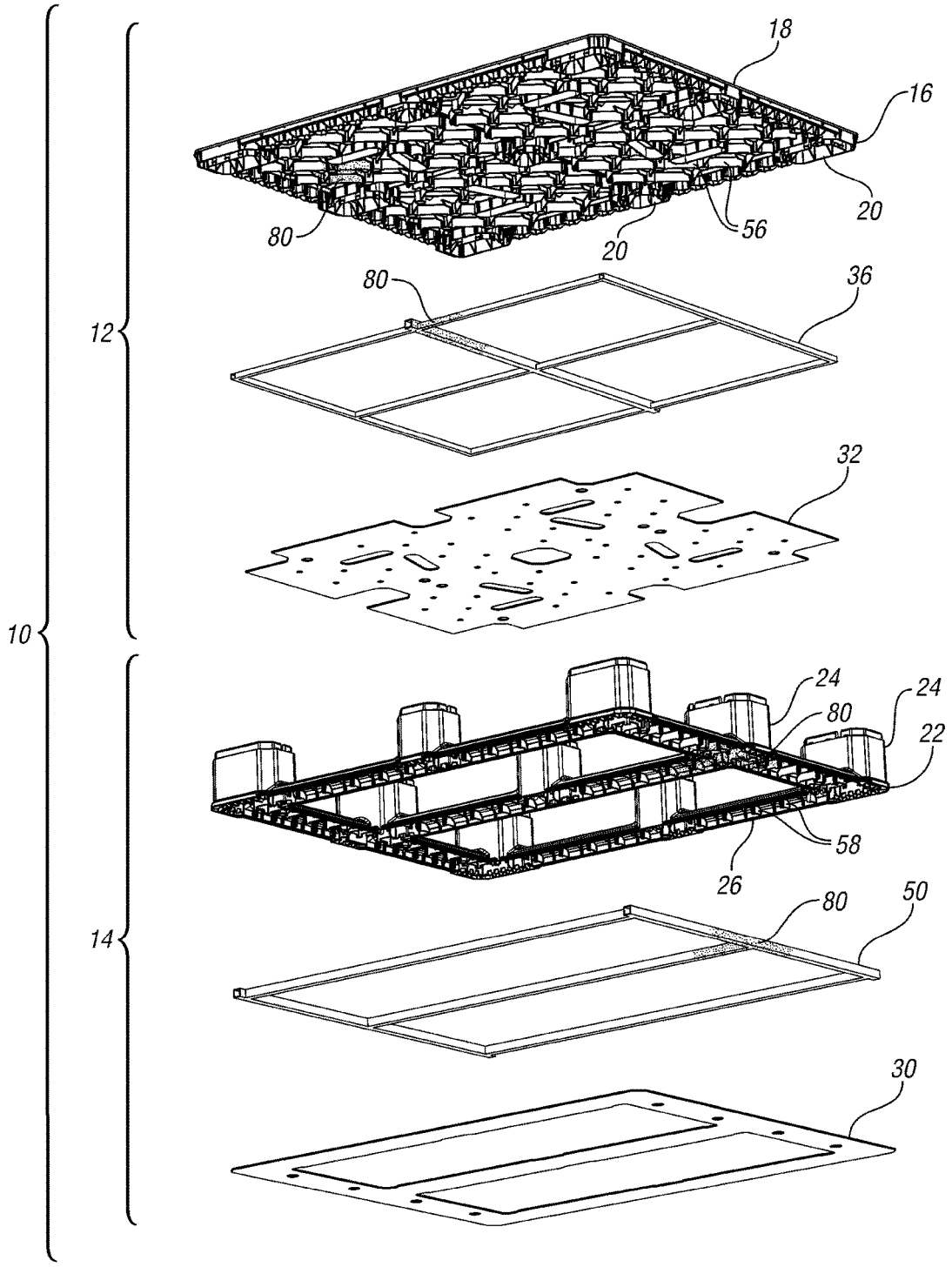
FIG. 7 is a bottom perspective view of the exploded pallet of FIG. 6.

FIG. 7 is an exploded bottom perspective view of the pallet assembly 10. The upper deck 16 includes a plurality of ribs 56 extending downwardly from the upper planar portion 18. The lower portion 22 also includes a plurality of ribs 58 extending downwardly.

Referring to FIGS. 6 and 7, several of the pallet assembly 10 components may receive a fire retardant coating 80, such as intumescent material. As another feature, the fire retardant coatings 80 may be placed on surfaces of the components that will ultimately be encapsulated inside the pallet assembly 10. This eliminates the chance that the fire retardant coating 80 will get worn off during use of the pallet assembly 10. For example, the coating 80 could be placed between the upper reinforcement sheet 32 and the upper deck 16, between the lower reinforcement sheet 30 and the lower portion 22 and/or within the columns 24, etc. Referring to FIGS. 6 and 7, the coating 80 could be placed on the surfaces of the plastic parts that will be encapsulated (e.g. upper surface of upper reinforcement sheet 32, lower surface of upper deck 16 (including ribs), upper surface of lower reinforcement sheet 30, lower surface of lower portion 22 (including ribs), and inside surfaces of columns 24) and/or could be placed on the reinforcement rods 52, 54 (could be on the outside surfaces, or could be on the inside surfaces, but preferably both inside and outside surfaces). The coating 80 would need to be located such that it would not interfere with joining the parts to one another (e.g. joining the upper reinforcement sheet 32 to the ribs of the upper structure 12). Although the coating 80 is only illustrated on portions of the enumerated surfaces, those entire surfaces would preferably receive the coating 80. The fire retardant coatings could be Aluminum Trihydrate (ATH), Intumescent material, Intumescent material combined with MDH and ATH, etc.

Figures 7A, 8:
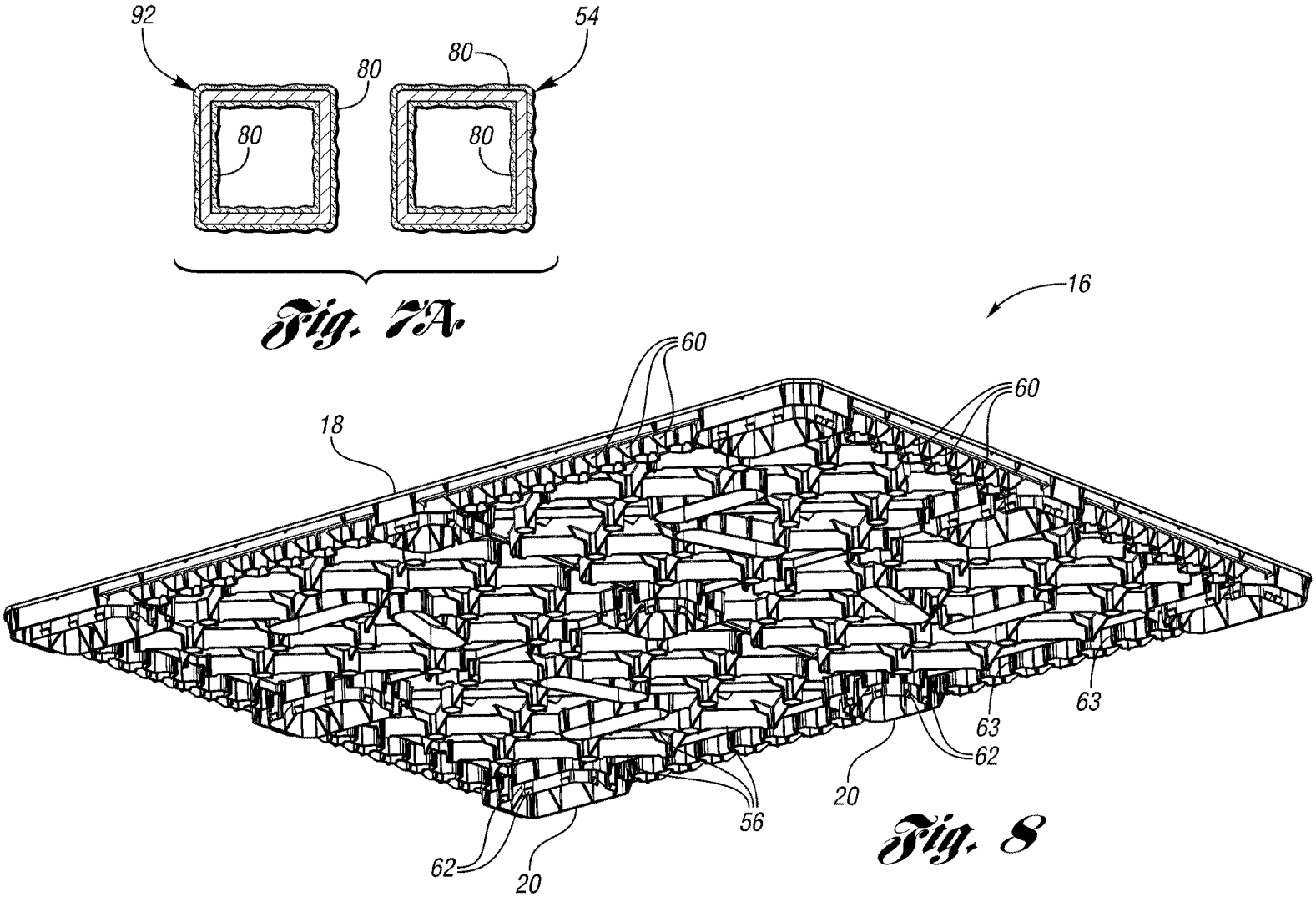
FIG. 7A is a section view of the reinforcement rods.
FIG. 8 is a bottom perspective view of the upper deck of the pallet of FIG. 1.

As shown in FIG. 7A, the coating 80 may cover the inner and outer surfaces of the reinforcement rods 52, 54. The coating 80 may cover most or all of the circumference of the inner and outer surfaces as shown. For fire retardant coatings 80 on the reinforcement rods 52, 54, especially if they are steel, preferably ATH is used because the ATH releases water during the fire, which lowers the HRR (Heat Release Rate). Each one of the ¾" reinforcement rods 52, 54 is a tube having more than 200 square inches of surface area (inside and out) that can be coated for added water release during the fire. There are up to 6 tubes of this size, which yields over 1200 square inches total.

Encapsulating the coatings 80 between pallet assembly 10 components can be done whether or not the plastic of the pallet assembly 10 is made with fire retardant additives; however, with the coatings 80, the amount of fire retardant additives in the plastic pallet components can be reduced, thereby improving their performance and cost. In the event of a fire, the upper reinforcement sheet 32 will partially melt or burn away early in the fire and expose the fire retardant coatings 80 within.

A bottom perspective view of the upper deck 16 is shown in FIG. 8. The plurality of ribs 56 and the column connectors 20 protrude downwardly from the upper planar portion 18. Snap-fit connectors 62 are formed at lower ends of the column connectors 20. Peripheral ribs 60 are provided along the periphery of the upper deck 16. Openings 63 are formed between some of the ribs 56 and column connectors 20 to accommodate the upper reinforcement frame 36 (FIG. 7).

Figure 9:
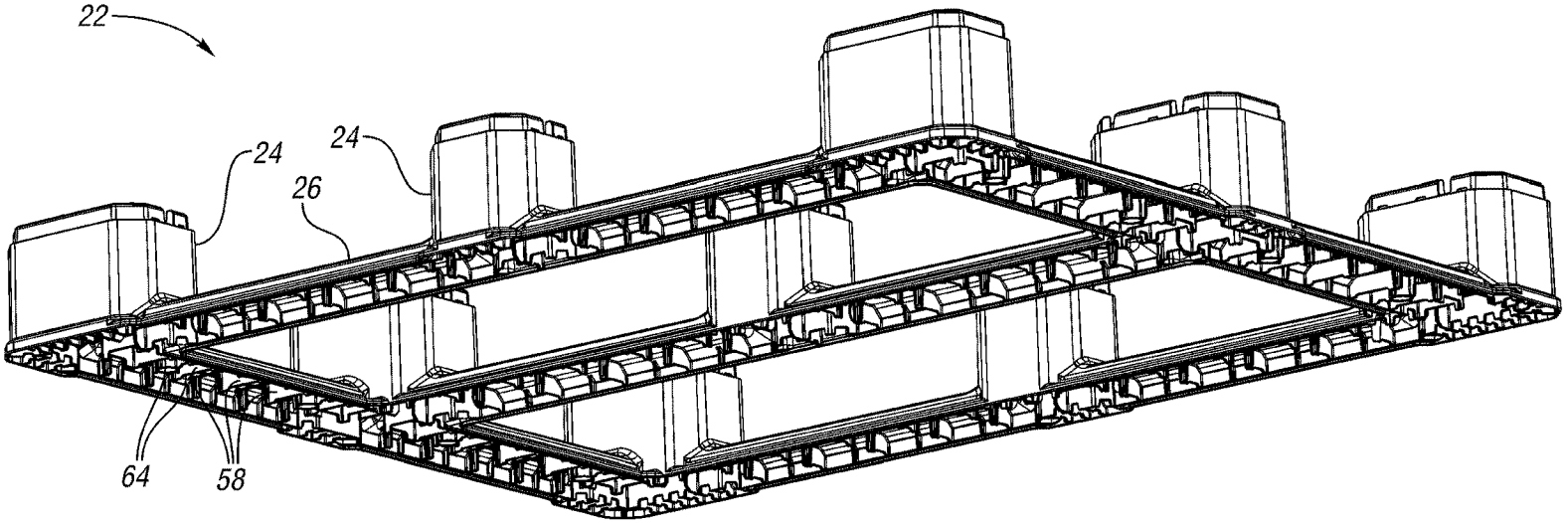
FIG. 9 is a bottom perspective view of the lower structure of the pallet of FIG. 1.

FIG. 9 is a bottom perspective view of the lower portion 22 in which the columns 24 and runners 26 are integrally molded as a single piece of plastic (such as polypropylene), such as by injection molding. A plurality of ribs 58 extend downward. Openings 64 may be formed through the ribs 58 to accommodate the lower reinforcement frame 50 (FIG. 7).

Some or all of the plastic components of the pallet assembly 10 may include some level of fire retardant additives, such as magnesium hydroxide (MDH). The amount of additives used in the plastic components may be reduced, if not eliminated, by several features, such as fire retardant coatings 80 elsewhere. First, the fire retardant characteristics of the large lower surfaces of the upper structure 12 and the lower structure 14 are the most important for fire retardancy. In this embodiment, this would mean that the upper reinforcement sheet 32 and the lower reinforcement sheet 30 are the most important for fire retardancy. Thus, the fire retardant additives could be added only (or mostly) to the upper reinforcement sheet 32 and the lower reinforcement sheet 30 such that the upper reinforcement sheet 32 and the lower reinforcement sheet 30 have a higher level of fire retardancy than the upper deck 16 and the lower portion 22.

Again, the amount of such additives may be reduced. Normally such components would require approximately 20% loading of fire retardant additives in order to meet UL 2335 and FM 4995 standards. Here, in combination with the use of the coatings, the additives can be reduced to below approximately 10% and more preferably below approximately 5%. This will significantly improve the performance characteristics of the plastic components and reduce their cost. Thus, the upper reinforcement sheet 32 and the lower reinforcement sheet 30 would be loaded to less than approximately 10% fire retardant additives and more preferably less than approximately 5%. If the upper deck 16 does not have the upper reinforcement sheet 32, then the upper deck 16 itself would be loaded to less than approximately 10% fire retardant additives and more preferably less than approximately 5%. If the pallet has runners 26, the runners 26 would be loaded to less than approximately 10% fire retardant additives and more preferably less than approximately 5%.

Figure 10:
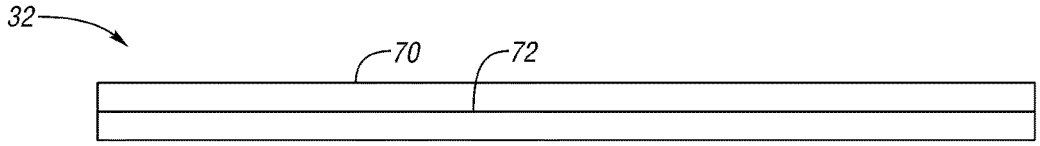
FIG. 10 is a section view of the upper reinforcement sheet of the pallet of FIG. 7.
Figure 11:
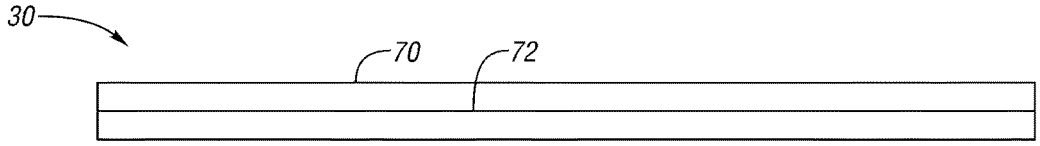
FIG. 11 is a section view of the lower reinforcement sheet of the pallet of FIG. 7.

A cross-section of the upper reinforcement sheet 32 is shown in FIG. 10. A cross-section of the lower reinforcement sheet 30 is shown in FIG. 11. Each sheet 30, 32 includes a pair of coextruded sheets or layers 70, 72. The upper layer 70 is formed of a material that matches the material of the upper deck 16 and the lower portion 22. For example, the upper deck 16 and lower portion 22 may be injection molded of high density polyethylene, and the upper layer 70 may be high density polyethylene. The matched materials improve the weld between the upper layer 70 and the upper deck 16 and lower portion 22 via vibration welding or hot plate welding. The lower layer 72 is formed of a material with improved fire retardant properties (such as halogens, metal hydrates, intumescents or other additives). In a fire, the bottom surfaces of the pallet assembly 10, including the bottom of the upper deck 16 and the bottom of the lower portion 22, including the runners 26 is the most important area for fire retardant material. By coextruding the fire retardant material in the lower layer 72 with the upper layer 70 of a material that matches the structure to which the sheet is bonded, a good bond can be obtained while also obtaining good fire retardant characteristics. The fire retardant coating 80 can be added to the upper surface of the upper layer 70 in areas where it will be encapsulated by the upper deck 16 or lower portion 22, without interfering with joining.

Figure 12:
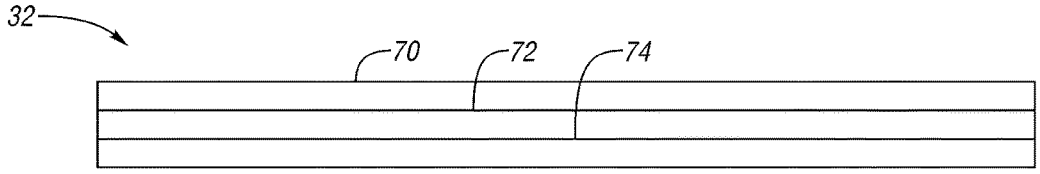
FIG. 12 is a section view of an optional upper reinforcement sheet.
Figure 13:
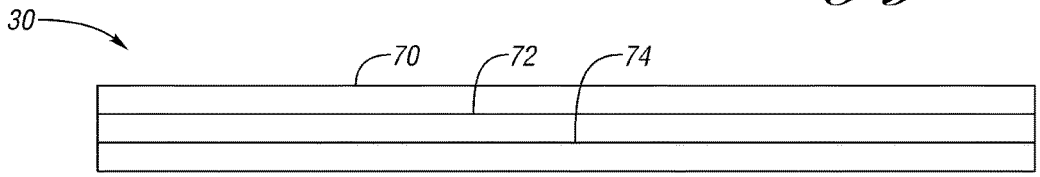
FIG. 13 is a section view of an optional lower reinforcement sheet.

FIG. 12 is a section view of an optional upper reinforcement sheet 32 and FIG. 13 is a section view of an optional lower reinforcement sheet 30. Each sheet 30, 32 includes three (or more) coextruded sheets or layers 70, 72, 74. Again, the upper layer 70 is formed of a material that matches the material of the upper deck 16 and the lower portion 22. For example, if the upper deck 16 and lower portion 22 may be injection molded of high density polyethylene, and the upper layer 70 may be high density polyethylene. The matched materials improve the weld between the upper layer 70 and the upper deck 16 and lower portion 22 via vibration welding. The middle layer 72 is formed of a material with improved fire retardant properties (such as halogens, metal hydrates, intumescents or other additives). The lower layer 74 could match the upper layer 70 (and match the upper deck 16 and lower portion 22). Alternatively, the lower layer 74 may be another layer of fire retardant material (which may be the same or different material as that of the middle layer 72). As another option, the layers 72, 74 could have increased stiffness (e.g. through additives—in fact, the fire retardant additives increase stiffness too) which may increase the overall stiffness of the pallet 10. This may also increase the brittleness of the layers 72, 74; however, because the sheets 30, 32 are spaced away from the perimeter of the pallet, they will be less subject to impact from fork tines, etc.

As mentioned above, many of the inventive features here could be incorporated into a nestable pallet having the upper deck 16 as its only deck and the supports 24 as the nestable feet. The coating 80 would be encapsulated within the deck 16 by the upper reinforcement sheet 32 secured to the ribs of the deck 16. Nestable pallets often do not have reinforcement rods but optionally they could include the reinforcement rods within the deck. As another option, the nestable pallet may not have the upper reinforcement sheet 32, in which case the coating 80 would just be applied to the underside of the deck 16 and/or in the feet.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet comprising:

a deck including a plurality of ribs between an upper planar portion and a lower planar portion;

a plurality of supports supporting the deck; and a fire retardant material between the upper planar portion and the lower planar portion and between the plurality of ribs.

2. The pallet of claim 1 wherein the fire retardant material is an intumescent material.

3. The pallet of claim 1 wherein the fire retardant material is a coating.

4. The pallet of claim 1 further including reinforcement rods between the upper planar portion and the lower planar portion and between the plurality of ribs, wherein the fire retardant material is in contact with the reinforcement rods.

5. The pallet of claim 4 wherein the reinforcement rods are hollow and the fire retardant material is inside the reinforcement rods.

6. The pallet of claim 5 wherein the fire retardant material is on outer surfaces of the reinforcement rods.

7. The pallet of claim 6 wherein the fire retardant material is an intumescent material.

8. The pallet of claim 1 wherein the fire retardant material is an intumescent material coating on the upper planar portion.

9. The pallet of claim 8 wherein the intumescent material coating is on the plurality of ribs.

10. The pallet of claim 1 wherein the deck is an upper deck and further including a plurality of runners connecting lower ends of the supports.

11. The pallet of claim 10 wherein the runners include a plurality of ribs and a lower reinforcement sheet secured thereto, the pallet further including intumescent material between the runners and the lower reinforcement sheet.

12. The pallet of claim 11 wherein the lower planar portion is formed of a polymer with additives improving fire retardant properties.

13. The pallet of claim 12 wherein the lower reinforcement sheet is formed of a polymer with additives improving fire retardant properties.

14. The pallet of claim 1 wherein the lower planar portion is formed of a polymer with additives improving fire retardant properties.

15. The pallet of claim 14 wherein the lower planar portion includes less than approximately 10% additives improving fire retardant properties.

16. The pallet of claim 15 wherein the lower planar portion includes less than approximately 5% additives improving fire retardant properties.

17. The pallet of claim 1 wherein the lower planar portion is an upper reinforcement sheet secured to the ribs.

18. A pallet comprising:

a deck including a planar portion and a plurality of ribs extending generally perpendicular thereto, the planar portion formed of a polymer having an additive for improving fire retardant properties of the polymer;

a fire retardant coating on the deck; and a plurality of supports supporting the deck.

19. The pallet of claim 18 wherein the planar portion of the deck is formed of a polymer with additives improving fire retardant properties.

20. The pallet of claim 19 wherein the planar portion of the deck includes less than approximately 10% additives improving fire retardant properties.

21. The pallet of claim 20 wherein the planar portion of the deck includes less than approximately 5% additives improving fire retardant properties.

* * * * *